United States Patent [19]

Colson, Jr.

[11] 4,015,379

[45] Apr. 5, 1977

[54] IN-GROUND SWIMMING POOL AND APPARATUS AND METHOD FOR CONSTRUCTING SAME

[76] Inventor: Andrew Elliott Colson, Jr., 22 Way Drive, Summit, N.J. 07901

[22] Filed: June 10, 1976

[21] Appl. No.: 694,828

[52] U.S. Cl. ..... 52/169.1; 52/250; 52/742; 249/DIG. 3; 264/35

[51] Int. Cl.[2] ..... E04H 3/16

[58] Field of Search ..... 52/169, 742, 247, 250, 52/261; 249/48, 19, 210, DIG. 3; 264/34, 35, 31

[56] References Cited

UNITED STATES PATENTS

| | | | |
|---|---|---|---|
| 1,666,554 | 4/1928 | Coddington | 249/18 X |
| 2,873,505 | 2/1959 | Sheldon | 52/169 X |
| 3,064,273 | 11/1962 | Kwake | 4/172.19 |
| 3,192,538 | 7/1965 | Walter | 4/172.19 |
| 3,416,165 | 12/1968 | Pereira | 52/152 X |
| 3,511,002 | 5/1970 | Fox | 52/146 |
| 3,574,870 | 4/1971 | Orelind | 4/172.19 |
| 3,579,665 | 5/1971 | Barker | 4/172.19 |
| 3,748,810 | 7/1973 | Mattingly | 52/742 |
| 3,929,944 | 12/1975 | Oliver | 249/DIG. 3 |
| 3,975,477 | 8/1976 | Molitor | 249/DIG. 3 |

FOREIGN PATENTS OR APPLICATIONS

| | | | |
|---|---|---|---|
| 1,434,860 | 2/1969 | Germany | 4/172.19 |
| 1,290,823 | 9/1972 | United Kingdom | 52/169 |

*Primary Examiner*—Leslie Braun

[57] ABSTRACT

An improved swimming pool or like arrangement is readily constructed within an excavation by erecting a modular frame lattice about the pool, and affixing removable concrete pouring form sheets to the frame. Concrete pool walls are then simply poured within the forms, the initially oversized earthen excavation back-filled, and the original pool surface apron secured to the lattice frame elements.

The pool fabrication method and apparatus of the instant invention employs a straight-forward sequence of frame and pouring form erection without requiring skilled labor for any of precisely dimensional excavation, concrete wall formation, repeated levelings, or the like. Moreover, the completed pool has internal mechanical integrity, and is relatively impervious to displacements of the surrounding back-fill attributable to freezing, thaw, or the like.

22 Claims, 3 Drawing Figures

IN-GROUND SWIMMING POOL AND APPARATUS AND METHOD FOR CONSTRUCTING SAME

DISCLOSURE OF THE INVENTION

This invention relates to swimming pools and, more specifically, to an improved pool arrangement, and apparatus and methodology for constructing such pool.

In prior art methods of constructing a swimming pool, the first step is to excavate a hole of precise dimensions and configuration. Since the walls of such excavations define the pool outer walls (and the amount of concrete required to reach the desired inner pool wall surface with its attendant material expense), it has been necessary after excavation to carefully fill all irregularities in the walls and often to add or subtract further earth to insure that the final dimensions were correct.

After an accurately excavated hole had been provided concrete is applied to the earthen walls to form the pool side surface. This was typically effected in either of two ways. In one approach, the concrete was simply mixed and installed by hand against the excavated earth wall. This is heavy, time consuming work requiring a high labor expenditure by relatively skilled artisans, and involved multiple movements of the concrete from a mixing location to the final installation area. Alternatively, the "Gunnite" (t.m.) method was used in which the concrete is sprayed against the wall of the pool by a high pressure multi-chamber gun, wherein cement/water mixing occurs at the spray orifices. This is somewhat faster than the hand packing method, but requires expensive special purpose equipment used by highly trained operators.

There is, of course, always the alternative of constructing a form and pouring the concrete for the pool walls. This eliminates some of the laborious concrete handling. It also eliminates the need for exactitude in the original excavation (assuming the earth is not relied upon as an outer form wall). Again, however, such a technique requires rather skilled and expensive labor to construct the pouring form which is made and assembled on an ad hoc basis to correspond to the desired pool shape.

It is thus an object of the present invention to provide an improved swimming pool arrangement and an improved method and apparatus for constructing such a pool.

More specifically, it is an object of the present invention to provide swimming pool constructing apparatus for forming a pool by mechanical assembly of a pool reinforcing framing truss which also firmly and correctly places removable concrete pouring form surfaces.

It is another object of the present invention that pool erection is effected by a mechanical prescribed rote process to fabricate a pool of any desired shape without requiring skilled artisans for excavation, concrete installation, or the like.

The above and other objects of the present invention are realized in a specific, illustration pool and pool-fabricating method and apparatus wherein earth is excavated with rough, overly-large and non-critically placed lateral walls. A pool reinforcing frame or truss, including concrete reinforcing rods is then developed by connecting frame elements to anchor posts regularly spaced about the pool periphery.

Concrete bounding form surfaces are affixed to the truss-like frame structure, and concrete side walls are poured therebetween. After loose back-fill, a horizontal pool apron is poured atop the back-fill and about laterally disposed frame truss reinforcing members.

The pool above described is self-supportive and mechanically stable even absent back-fill. Further, it is assembled as a routine matter by inter-connecting mechanical members in a prescribed manner—without requiring exercise of any skilled calling for excavation, earth moving or the like.

The above and other features and advantages of the present invention will become more clear from the following detailed description of a specific embodiment thereof, presented hereinbelow in conjunction with the accompanying drawing, in which.

Figure 1:
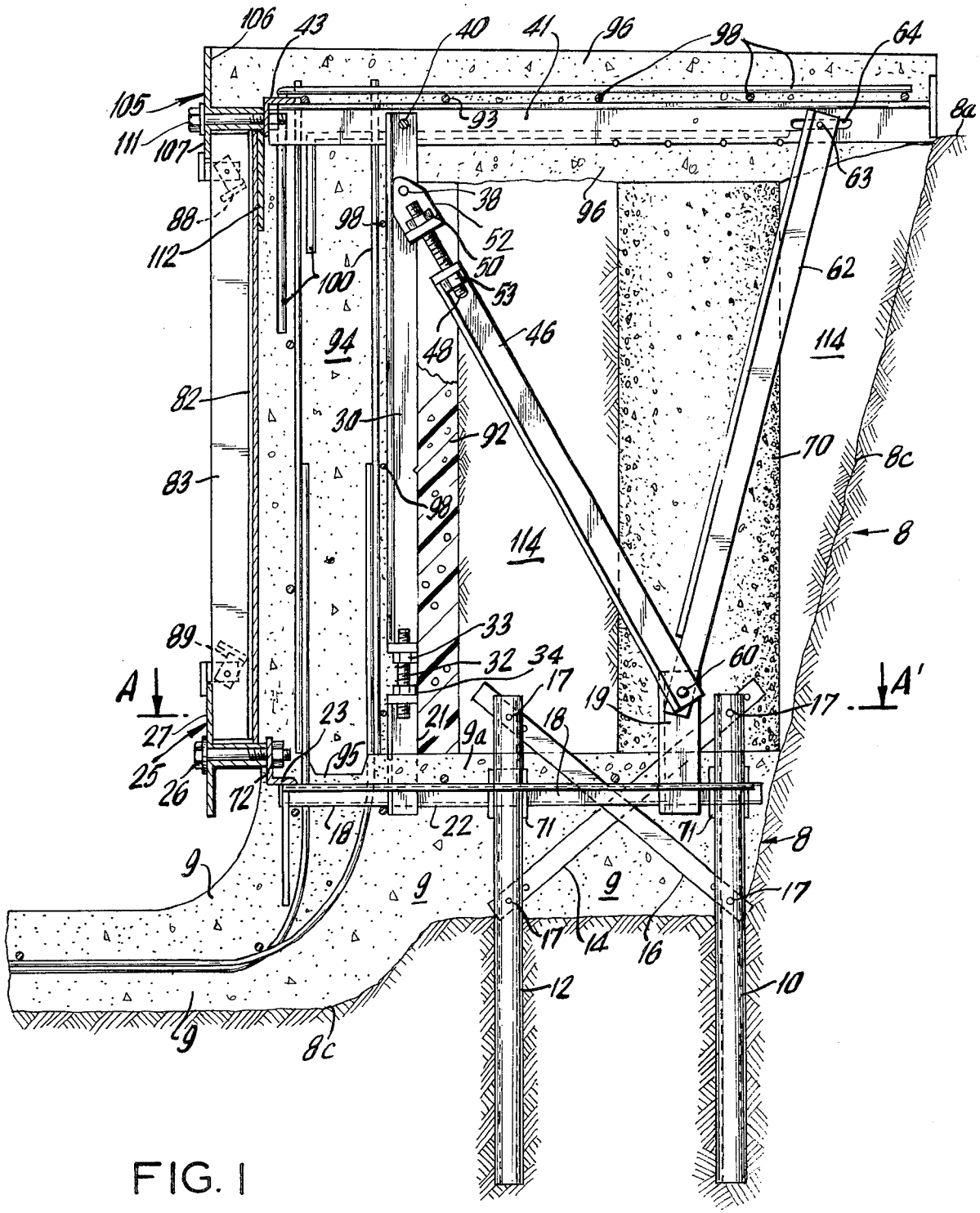
FIG. 1 is a cross-sectional side view depicting shallow end structure of a pool constructed in accordance with the principles of the present invention.
Figure 2:
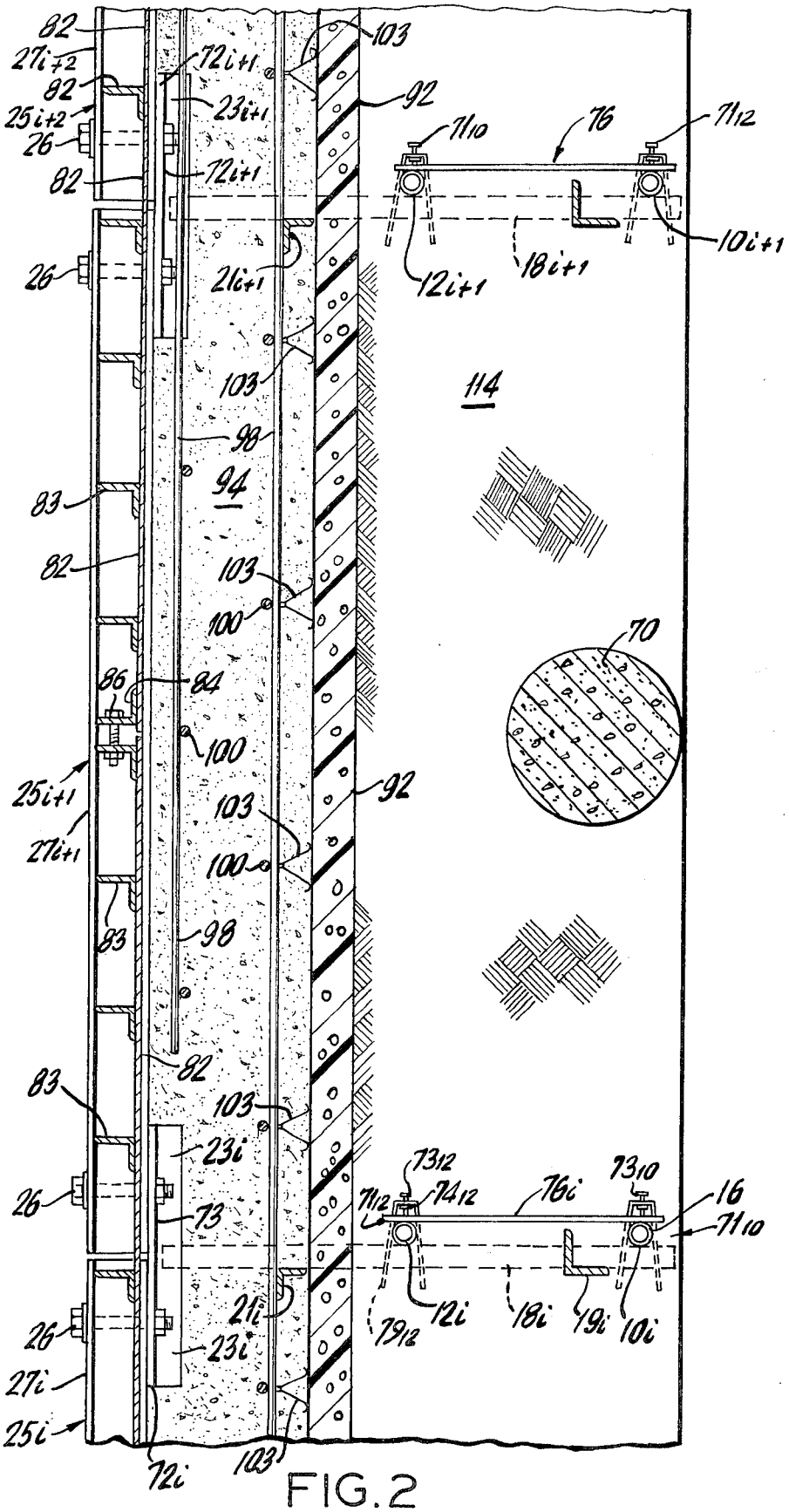
FIG. 2 is a cross-sectional plan view at a Section A–A′ of FIG. 1.

Referring now to FIGS. 1 and 2, there is shown in cross-sectional form, side and plan views respectively illustrating a pool (e.g., a swimming pool) formed in accordance with the principles of the present invention, and also the apparatus and methodology employed to construct such a pool. As a first step in pool fabrication, the earth having a normal level 8*a* is excavated to form a hole bounded by surface 8. The excavation includes a bottom pool surface 8*c*, a section 8*b* beneath the pool side wall area, and a side wall 8*c*. The excavation need not be accurate as to lateral form, and variances in the shape or location of the surface 8*c* are not critical. Thus the excavation may readily be effected by bulk earth moving equipment without requirement for attention to fine detail by a skilled operator.

After the excavation is completed, plural pairs of anchor posts 10 and 12 are embedded in the ground and disposed about the periphery of the pool. The port pairs 10 and 12 are equally spaced (e.g. 4 feet apart), each pair 10 and 12 being disposed generally normal to the intended pool side wall. Thus the locus of outer or inner anchor posts 10 or 12 correspond to the shape desired for the pool—whatever that shape is to be, but are of slightly larger form. If desired, cross struts 14 and 16 may reinforce each pair of anchor posts 10 and 12, as by bolt or rivet fasteners 17.

Plural base locator arm members 18 are each secured to an associated pair of anchor posts 10 and 12, as by pipe clamp type fasteners 71, fasteners $\mathbf{71}_{10}$ and $\mathbf{71}_{12}$ being shown in FIG. 2 as connecting the *i*th set of anchor posts $\mathbf{10}_i$ and $\mathbf{12}_i$ to the arm $\mathbf{18}_i$. As is per se conventional, the pipe clamps 71 include a U-shaped bracket member 79 having apertures therein to pass the arm member 18, and a screw 73 acting through a nut 74 welded to the bracket 72 for clamping arm 18 to the corresponding anchor post 10 or 12. Again if desired for reinforcing purposes, a longitudinal brace 76 may be employed at each clamping station between each locator arm 18 and anchor posts 10 and 12.

Secured to each base locator arm member 18, as by welding, are two brackets 19 and 21 for receiving frame support truss members below discussed, and also a front bracket 23 having a verticle front flange 72. The several arms 18 about the pool are vertically adjusted on the anchor posts 10, 12 to the same level, and are laterally or radially adjusted such that the front surfaces of the verticle flanges 72 generally correspond to the desired shape of the pool.

A frame girder 30 is attached to the arm 18 bracket 21 and appropriately vertically positioned by a screw 31-nut 33,34 fastener. A cross brace 46 cooperating with a bracket 52 via a screw-nut fastener 48, 50, 53 is attached between the girder 30 (as by nut and bolt 38) and the bracket 19 (as by nut and bolt 60). The basic steel frame segment at the shallow end cross-sectional location depicted in FIG. 1 is substantially completed by an upper platform (pool apron) support member 41 connected as by a nut and bolt 40 to girder 30 and cross brace member 62 bolted at 60 to the bracket 19 and affixed by nut and bolt 63 to the platform support 41 at a small adjustment slot 64. The frame members above described at the FIG. 1 cross sectional anchor post location may simply be installed in any convenient order on a location by location basis, e.g. in the order 10–12, 18, 30–62–41 and 46.

Secured to the front flanges 72 of brackets 23 on the several base locator arms 18 are a series of bottom form retaining runners 25. Each runner 25 is secured by bolts 26 to the flanges 72 on two adjacent arms 18. Thus, for example, the bottom form retaining runner $25_{i+1}$ in FIG. 2 is bolted to flanges $72_i$ and $72_{i+1}$ associated with the locator arms $18_i$ and $18_{i+1}$. Similarly, upper form retaining runners 105 are each secured to flanges 43 on adjacent upper platform support frame members 41.

The upper form retaining runners 105 each include a downwardly extending flange 107, and the bottom form retaining runners 25 each include upwardly extending vertical flanges 27. For purposes of defining the inner pool surface (i.e., the pool surface wall adjacent the water once a completed pool is filled), a series of sheets 82 of a material which do not adhere well to concrete, e.g., fiberglass, are inserted between the form-retaining runners 25 and 105 and supported by the horizontal upper bottom surface of the lower runners 25. Individual fiberglass sheets 82 are sitiffened in the vertical direction by a series of stiffener members 83, e.g., of an L-shaped cross-section, such that the sheets 82 are form stable and do not bow in the vertical direction, but may be horizontally shaped to conform to curves in the desired pool configuration. An additional vertical stiffening member 84 is included at one end of each fiberglass sheet such that adjacent fiberglass members 82 may be joined, as by a bolt 86 connecting the extra, direction-inverted stiffener 84 with the nearest end stiffener 83 of the adjacent sheet. To retain the sheets and stiffeners 82–83–84 in place laterally, form-locks 88 and 89 may be rotated from their dashed position in FIG. 1 to the solid line positions there shown to engage the upper ends of the upper and lower runner flanges 27 and 107. With the locks 88 and 89 in place, the inner form surface 82 cannot move laterally.

Thus, the secured and securely positioned fiberglass sheets 82 comprise a form which defines the inner bound for the concrete pool wall. The sheets 82 may be positioned all the way around the inner pool surface if the concrete pool wall is to be made in one continuous pouring. Alternatively, a number of the sections 82, but fewer than the number of sections required to completely define the inner pool wall, may be employed where the pool wall is to be formed by a sequence of pours.

To define the outer surface of the pool, i.e., the wall surface remote from the pool interior, (and also to provide thermal insulation in the completed pool) a form, bounding layer 92, e.g., of styrofoam, is secured in place as by attachment to the brackets 21 affixed to the locator arms 18 and by attachment to the girders 30 disposed atop the brackets 21. The styrofoam may be secured in place by simple wire ties to the vertical bracket and girder elements 21 and 30. Thus, a pool wall surface is defined by the rectangular spacing between the facing surfaces of the fiberglass sheets 82 and the styrofoam sheets 92.

To complete the mechanical pool assembly before concrete pouring, a number of concrete reinforcing rods 98 and 100 are inserted in the cavity between the fiberglass 82 and styrofoam 92, and also in the horizontal area about the plane of the upper platform supports 41 which, as discussed below, will become the pool apron or platform area. For conciseness, the horizontally disposed reinforcing rods are all identified by the numeral 98, and the vertical disposed rods identified by the numeral 100. Where a single rod is bent to have both horizontal and vertical sections, each number 98 or 100 attaches to the appropriate portion thereof.

As a generality, the reinforcing rods are tied to mechanical frame elements, or to each other at their intersections, by wire ties per se long known for that purpose in the art. Accordingly, for purposes of conciseness, no detailed presentation or discussion is made of the particular reinforcing rods or their installation, other than to note the general distribution of the rods throughout areas to be concrete-filled to perform their per se long recognized concrete tension strengthening function. It is observed, however, that the reinforcing rods are secured to mechanical members to insure that they are actually embedded within the interior of the concrete zones where they will effect their concrete reinforcing function, and are not randomly distributed or left afloat where they might creep or float to the concrete surface. To this end, vertically extending spacer feet 103 are employed to separate the horizontal and vertically extending reinforcing rods 98 and 100 nearest the styrofoam sheets 92 to position these rods at least several inches into the concrete wall zone.

With the mechanical assembly of FIG. 1 above described completed (and that for the deep end pool zone shown in FIG. 3 and disclosed below, but which is very similar to the FIG. 1 arrangement), the pool concrete floor and wall base 9 is poured or otherwise formed in any manner known in the art up to an upper surface 9*a*. After the floor and base has set, concrete is then simply poured between the fiberglass sheets 82 and the styrofoam sheets 92 to form the pool wall 94. The wall is thus formed of the required thickness and rectangular shape established by the fiberglass 82 and styrofoam 92 without waste of material, and without requirement for precise excavating, or the like. Also for pool platform supporting purposes, a concrete pier 70 is formed remote from the pool interior vis-a-vis- the concrete wall 94 formed between the fiberglass 82 and the styrofoam 92. The pier 70 may be formed after the concrete floor 9 is completed as shown in FIG. 1. Alternatively, the pier 70 may be formed on its own footing before the floor 9 is fabricated, the floor and base 9 thus being disposed about the pier 70 which passes therethrough.

After the wall 94 is poured, earth is loosely back-filled at the rear of the styrofoam material 92 to the original excavation wall 8*c*.

After the above operations are effected, the pool is completely defined in the sense of a side wall 94 affixed to a floor and base 9. Further, the desired position for the pool apron or platform area 96 is defined by the location of the upper form retaining runners 105. Thus, unlike prior art methodology, all pool dimensioning and element locations follow from erection of the anchor posts 10 and 11 and positioning of the base locator arms 18. Further positional definition, leveling and the like is not required. A platform 96 is formed to complete the basic pool fabrication by simply pouring concrete on top of the completed wall 94 and atop the back-fill area 114 and the pier 70.

Following completion of the pool walls as above described, the upper and bottom retaining runners 105 and 25 are removed by withdrawing the bolts 26 and 111, unfastening the form-locks 88 and 89, followed by removal of the fiberglass sheets 82 which are all thus repeatedly reusable. The several sheets 82 of course should be unbolted by removal of bolts 86 to facilitate their removal. Removal of the sheets 82 is also enhanced by initially coating the sheets with a quick release gel or the like and, should any sheet be difficult to remove, application of compressed air forced between the sheets 82 and the newly formed concrete wall. Air receiving nipples may be utilized in the sheets 82 for this purpose. Further, an L-shaped runner member 112 may be employed in the original frame structure, and removed after the concrete sets to leave a recess about the upper vertical edge of the pool to be filled by tile or the like for aesthetic purposes if desired. Finally, the small holes created by removal of the bolt-containing portion of the bottom runner 25 may be filled in with any conventional potting material, e.g. epoxy. This is again for aesthetic purposes only—the small holes left upon removal of the runners 25 are completely surrounded by concrete and thus water tight.

It is observed that the upper pool apron or platform 96 is reinforced and supported by steel structural frame 10–12–18–30–41–46–62 at each anchor post station, and further supported by the spaced concrete piers 70 (as well as the reinforcing rods 98 and 100 embedded therein). It thus has internal integrity, is self-supportive and does not rely for such purposes upon the back-fill 114. Thus, heaving of the loosely packed back-fill by freezing, thawing or the like does not produce substantial upward displacing forces on the upper platform which would tend to create cracks or dislocations of the platform 96.

Figure 3:
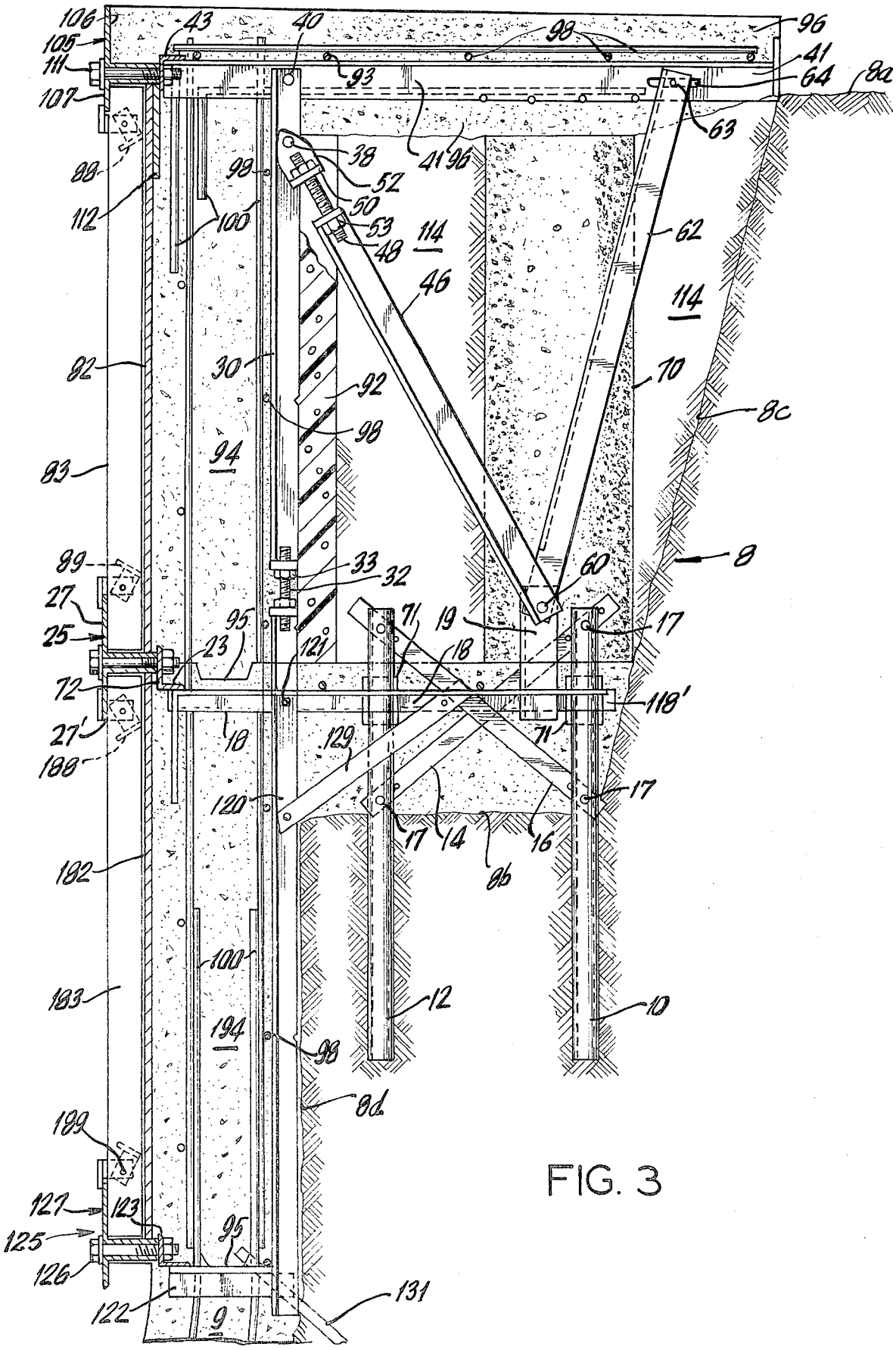
FIG. 3 is a cross-sectional side view of a pool about a deep end of the pool.

Referring briefly now to FIG. 3 there is shown the frame organization which is erected at anchor post stations about the deep side of the pool. The FIG. 3 structure is substantially like the shallow end structure of FIG. 1 other than for the downwardly extending elements discussed below and will not otherwise be considered in detail. Like numbered or depicted elements perform similar functions in the arrangements of FIGS. 1 and 3.

At the deep end arrangement of FIG. 3, the excavation has an additional vertical surface 8*d* beyond the level 8*b* obtaining at the shallow end. After the anchor posts 10 and 12 are inserted in the ground beneath the surface 8*b*, a locator arm 118′ is secured thereto by fasteners 79. The locator arm 118′ is similar to the arm 18 except that it merely includes a bolt receiving aperture in place of the bracket 21. A downwardly extending girder 120 is affixed to the locator arm 118′ via a nut and bolt or other fastener 121, and advantageously also if desired, via a bracing strut 129. Thereafter, all of the framing structure above the rod 118′ is constructed in a manner identically parallel to the structure above the locator arm 18 for the shallow end, FIG. 1 arrangement.

The girder 120 includes a lower laterally forward extending arm 122 (as welded thereto) which, in turn, includes a bracket having a front flange 123. Lower form retaining runners 125 are bolted by bolts 126 to the flanges 123 at the several anchor post 10 and 12 locations in a manner identically paralleling installation of the bottom form retaining runners 25 which are affixed to the flanges 72 attached to the locator arms 118′ (and 18 in the case of FIG. 1). Rib-reinforced fiberglass sheets 82 are then installed between lower flange 27′ of the bottom form retaining runners 25 and flanges 127 of the lower retaining runners 125 via rotatable key locks 188 and 189. Accordingly, a continuous inner concrete pouring form is formed between upper sheets 82 and lower fiberglass sheets 182. The outer lower area pool wall may be defined by the earth nearby the girders 120 as shown. Alternatively, a styrofoam layer 92 may be downwardly extended by additional styrofoam sheet material if desired, the excavation, of course, being enlarged for such an alternative construction to permit insertion of the extra styrofoam form material.

As before, the pool floor surface is first formed. Thereafter, the wall 94–194 at the deep end may be formed in one or more pours, as desired. Where vertical adjacent concrete wall portions are formed at different times, a lapped, tongue-and-groove like structure is formed as at 95 in FIGS. 1 and 3 created for its usual purposes of creating a water seal, and also aiding in resisting lateral forces imposed on the pool walls, as by water pressure once the pool is filled. Further, if desired, stakes 131 may be employed to rigidly hold the lower portion of the girders 120 in place through the concrete pouring and setting operations.

The above arrangement, apparatus and methodology has thus been shown to form a pool of structural integrity, which is assembled by a rote prescribed sequential installation of mechanical frame members and the like. The pool is created without requiring the labor of skilled artisans for critical earth excavations, multiple levelings, skilled manual or "Gunnite" concrete or cement applications or the like. Pools of the instant construction formed by the present technology may thus be readily formed at relatively low cost vis-a-vis prior art methods and apparatus.

The above apparatus and process steps are merely illustrative of the principles of the present invention. Numerous modifications and adaptations thereof will be readily apparent to those skilled in the art without departing from the spirit and scope of the present invention. Thus, for example, only one of the post pairs 10–12 (e.g., post 10) need be anchored in the ground. By merely terminating the other post (e.g.,12) of each pair at the earth surface. This permits angular rotation for fine positional correction of the elements 10–12–18.

Also, it will be apparent that the apparatus and method of the present invention is applicable to pool-analagous applications, e.g., retaining or barrier walls or the like.

What is claimed is:

1. In combination in apparatus for fabricating a pool, plural pair of anchor posts spaced about a pool periphery, at least one of each pair of said anchor posts being partially axially disposed in a pool substrata, plural horizontally disposed locator arm means each affixed to a different pair of said anchor posts, plural frame lattice means each affixed to a different, associated one of said locator arm means, outer pool wall defining form means affixed to said frame means and oriented in a direction between adjacent ones of said frame means, plural bottom form retaining runner means each secured to a different, adjacent pair of said locator arm means, plural upper form retaining means each affixed to a different adjacent pair of said frame means, and plural contiguous inner pool wall defining form sheet means secured between said upper and bottom form retaining runner means and oriented in a direction between adjacent ones of said frame means.

2. A combination as in claim 1 wherein said frame means includes a girder connected to said base locator arm means, horizontally disposed upper platform support means connected to said girder, and cross-brace means connecting said upper platform support means and said base locator arm means.

3. A combination as in claim 2 wherein said frame means further comprises additional cross-brace means connecting said girder and said base locator arm means.

4. A combination as in claim 3 further comprising means for varying the length of said additional cross-brace means.

5. A combination as in claim 4 further comprising vertical concrete pier means, concrete wall means between said inner and outer wall form means, and horizontally disposed concrete platform means disposed above said upper platform support means and atop said concrete pier means.

6. A combination as in claim 1 further comprising vertical concrete pier means, concrete wall means between said inner and outer wall form means, and horizontally disposed concrete platform means disposed about said upper platform support means and atop said concrete pier means.

7. A combination as in claim 5 wherein said inner wall defining form means includes plural vertically disposed reinforcing ribs.

8. A combination as in claim 7 wherein said inner wall form means further comprises locking means for securing said form means to said runner means.

9. A combination as in claim 8 further comprising plural metallic reinforcing rods disposed within said concrete wall means and said concrete platform means.

10. A combination as in claim 9 further comprising plural vertically disposed foot means engaging said outer wall defining form means for spacing therefrom and within said concrete wall means a plurality of said metallic reinforcing rods.

11. A combination as in claim 10 further comprising additional runner means contiguous with the upper portion of said inner wall floor means for creating a decorative material receiving recess in said concrete wall means.

12. A combination as in claim 10 further comprising pool floor and wall base means disposed at the bottom of the pool excavation and engaging said concrete wall means.

13. A combination as in claim 12 wherein at least one of said frame means includes additional girder means affixed to said locator arm means, plural lower form retaining runner means each attached to a different pair of adjacent additional girder means, and an additional plurality of inner pool wall defining form means secured between said bottom form retaining runner means and said lower form retaining runner means in a direction oriented between adjacent ones of said frame means.

14. A combination as in claim 2 wherein at least one of said frame means includes additional girder means affixed to said locator arm means, plural lower form retaining runner means each attached to a different pair of adjacent additional girder means, and an additional plurality of inner pool wall defining form means secured between said bottom form retaining runner means and said lower form retaining runner means in a direction oriented between adjacent ones of said frame means.

15. A method for forming a pool comprising the steps of excavating a pool cavity, partially embedding at least one of plural anchor post pairs into the foundation strata, said post pairs being disposed about the periphery of the pool, attaching base locator arm members horiontally to each anchor post pair, affixing a self-supportive frame structure, including a horizontal upper platform support, to each base locator arm member, connecting upper form retaining runners between adjacent frame structures and connecting bottom form retaining runners between adjacent base locator arm members, erecting an outer pool defining wall form between adjacent frame structures, and attaching vertically oriented inner pool wall defining form means between the upper and bottom form retaining runners.

16. A method in claim 15 further comprising the steps of forming a concrete pool floor and wall base about the bottom of said pool excavation, and pouring concrete pool walls between said inner and outer pool wall defining form means.

17. A method as in claim 16 further comprising the steps of erecting a vertical piers about the pool periphery on the side of the pool wall remote from the pool interior, back-filling about said piers, and pouring a concrete platform atop said wall, pier and back-fill and about the frame upper platform support elements.

18. A method as in claim 16 further comprising the step of installing concrete reinforcing rods in the wall area space.

19. A method as in claim 15 further comprising the steps of attaching each of a plurality of lower vertically disposed girder means to a different one of horizontally disposed locator arm members, attaching a lower form retaining runner between the lower portions of adjacent lower girders, and installing lower area inner pool wall defining members between the bottom and lower form retaining runners.

20. A method as in claim 19 further comprising the step of pouring concrete into the space between the lower pool inner wall defining means and the lower girder means.

21. In combination in pool apparatus, plural pair of anchor posts spaced about a pool periphery, at least one of each pair of said anchor posts being partially axially disposed in a pool substrata, plural horizontally disposed locator arm means each affixed to a different pair of said anchor posts and having a lateral inner end portion disposed toward the pool interior, plural frame lattice means each affixed to a different, associated one of said locator arm means, said frame means including a girder connected to said base locator arm means, horizontally disposed upper platform support means connected to said girder, and cross-brace means connecting said upper platform support means and said base locator arm means, plural vertical concrete pier means, concrete wall means connecting said frame lattice means and including a portion of each frame lattice means and the inner end portions of said locator arm means, and horizontally disposed concrete platform means disposed about said upper platform support means and atop said concrete pier means.

22. A combination as in claim 2 wherein said frame lattice means further comprises additional cross-brace means connecting said girder and said base locator arm means.

* * * * *